United States Patent [19]

Walker et al.

[11] Patent Number: 4,850,260

[45] Date of Patent: Jul. 25, 1989

[54] APPARATUS FOR REDUCTION OF MUNITION FRATRICIDE HAZARD

[75] Inventors: Evan H. Walker, Aberdeen; Gould Gibbons, Finksburg, both of Md.

[73] Assignee: United States of America as represented by the Secretary of The Army, Washington, D.C.

[21] Appl. No.: 205,597

[22] Filed: Dec. 24, 1987

Related U.S. Application Data

[63] Continuation-in-part of Ser. No. 917,758, Sep. 29, 1986, abandoned, which is a continuation of Ser. No. 700,988, Oct. 16, 1984, abandoned.

[51] Int. Cl.[4] ..... F42B 37/02

[52] U.S. Cl. ..... 89/34; 89/36.02; 206/3

[58] Field of Search ..... 89/34, 36.02, 40.07; 206/3, 443, 591, 593, 814

[56] References Cited

U.S. PATENT DOCUMENTS

| | | | |
|---|---|---|---|
| 2,738,297 | 3/1956 | Pfistershammer | 89/36.02 |
| 3,736,838 | 6/1973 | Butterweck et al. | 89/36.02 |
| 3,771,418 | 11/1973 | Gulbierz et al. | 89/36.02 |
| 4,111,097 | 9/1978 | Lasker | 89/36.02 |
| 4,222,484 | 9/1980 | Howe | 206/3 |
| 4,286,708 | 9/1981 | Porzel | 206/3 |
| 4,476,988 | 10/1984 | Tanner | 206/3 |

FOREIGN PATENT DOCUMENTS

| | | | |
|---|---|---|---|
| 2812226 | 10/1979 | Fed. Rep. of Germany | 89/34 |
| 2926815 | 1/1981 | Fed. Rep. of Germany | 89/36.02 |

*Primary Examiner*—Stephen C. Bentley
*Attorney, Agent, or Firm*—Saul Elbaum; Walter R. Baylor; Guy M. Miller

[57] ABSTRACT

Shields of tungsten-plastic composite material are strategically disposed intermediate neighboring rounds of ammunition containing highly sensitive cyclotol explosive. The shield's shape and composite structure permit the rounds to be more closely stored in tank and depot applications, with reduced danger of propagation of detonation and fratricide hazard.

8 Claims, 1 Drawing Sheet

APPARATUS FOR REDUCTION OF MUNITION FRATRICIDE HAZARD

GOVERNMENTAL INTEREST

The invention described herein may be manufactured, used and licensed by or for the Government for governmental purposes without the payment to us of any royalty thereon.

The application is a continuation-in-part of application Ser. No. 06/917,758 filed Sept. 29, 1986, now abandoned, which is a continuation of application Ser. No. 06/700,988, filed Oct. 16, 1984, now abandoned.

BACKGROUND OF THE INVENTION

1. Field of the Invention

This invention relates to an apparatus having a composition which when strategically positioned between explosive rounds prevents propagation of detonation between rounds. The present invention is particularly suitable for use in tank ammunition storage compartments, munition storage depots, and munition transport vehicles.

2. Description of the Prior Art

In the past, prior art techniques for preventing propagation of detonation between pallets of ammunition, such as artillery shells, have required large amounts of massive material, such as steel, sand bags or reinforced concrete. For large shells such as the 155 mm round, packed eight to a pallet, at least 10 cm of steel was required to prevent propagation between pallets, where such pallets were-separated from each other by a distance of approximately one meter. It has also been shown at the Ballistic Research Laboratory, Aberdeen Proving Ground, Md., that propagation between pallets holding 155 mm rounds could be prevented by using the combination of 30 cm sandbags and 10 centimeters of air space. The problem with both the former and latter approaches were that they required too much space between rounds to be practical for on board tank applications and too heavy and clumsy for use in transport situations. The problems of limiting propagation of detonation are further exacerbated when dealing with shock sensitive ammunition containing cyclotol, Type 8151 or other high RDX concentration explosives such as Comp. A3. In particular, the storage of 120 mm High Explosive Anti-Tank (HEAT) rounds containing the aforementioned highly sensitive explosive charge on XM1 tank, which was originally designed to store the smaller 105 mm ammunition, represents a considerably greater problem in storage than can be solved by the prior art technology.

3. Prior Art Disclosure

A design suitable for use in XM1 tanks for storage of 105 mm, M456, HEAT-T rounds was disclosed in Memorandum Report No. ARBRL-MR-02827 by the U.S. Army Research and Development Command at the Ballistic Research Laboratory, Aberdeen Proving Ground, Md. The design comprised polyurethane shields 3.30 cm×5.08 cm×40.49 cm thick pieces having an average density of 0.902 grams/cm$^3$ placed between rounds with a spacing of approximately 5.6 cm between the outer walls of the rounds. The aforementioned shielding was not sufficient to prevent large, high RDX concentration explosive filled rounds having walls separated from each other by the same or smaller distances, from propagating detonations.

SUMMARY OF THE INVENTION

Primary and secondary shields of special composition are strategically placed between collocated highly sensitive explosive containing ammunition, capable of preventing propagation of detonation between neighboring rounds. An object of the present shield configuration is to provide a shield capable of preventing the propagation of detonation between 120 mm HEAT rounds loaded with sensitive explosive in either the pressed or cast form.

Another object of the present invention is to provide a shield for the reduction of the hazard of tank munition fratricide wherein 120 mm explosive containing rounds are separated from each other by as little as 3.05 cm.

A further object of the present invention is to provide a composite material shield for preventing propagation of detonation between shock sensitive ammunition used in tank ammunition storage compartments, munition-storage depots, and munition transport vehicles.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
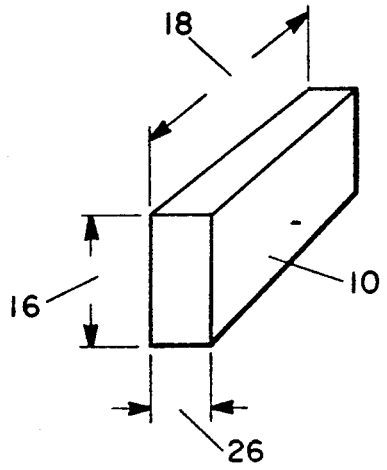
FIG. 1 is an isometric view of the main shield shape.
Figure 2:
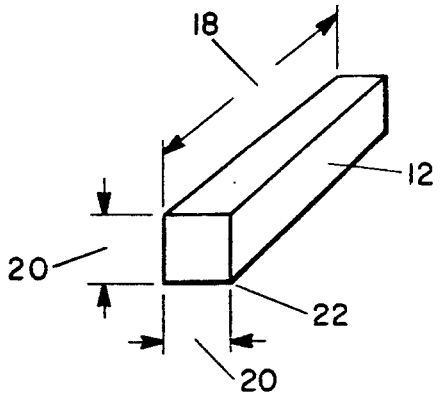
FIG. 2 is an isometric view of the secondary shield shape.
Figure 3:
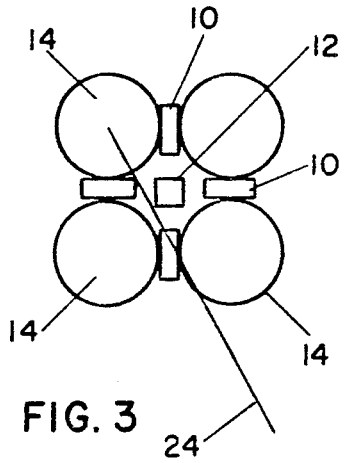
FIG. 3 is a plane view of the main and secondary shields and rounds in a rectangular packing configuration.
Figure 4:
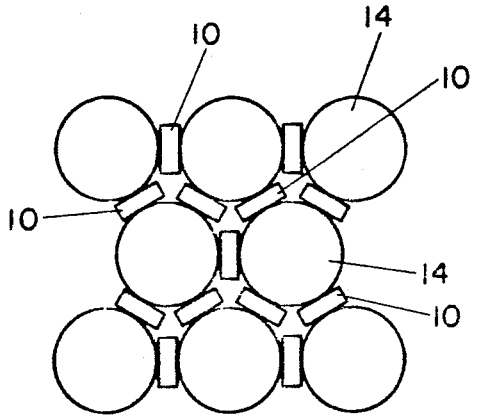
FIG. 4 is a plane view of the main and secondary shields and rounds in a hexagonal packing configuration.

Referring now to FIGS. 1–4, the schematic drawings show rectangular and square shaped primary and secondary shields 10 and 12, respectively, as applied between 120 mm HEAT rounds 14 used in an XM1 tank. The width 16 of the primary shield 10 should be half the diameter of round 14. The length 18 of both the primary and secondary shields 10 and 12, respectively, must overlap and extend beyond the portion of the shell or round 14 containing the explosives to be shielded. The width and thickness 20 of the secondary shield 12 should be such that the corners 22 of the secondary shield 12 touch an imaginary line 24 drawn from the center of round 14 drawn tangent to the nearest diagonal neighboring round 14 as shown in FIG. 3. The thickness 26 of the primary shield 10 in the preferred embodiments equals the space available between rounds. For the 120 mm HEAT round this space is equal to 3.05 cm. In the rectangular packing configuration of FIG. 1, the primary shield 10 is placed between side by side warheads 14; the secondary shields 12 are placed midway between diagonally neighboring rounds. In the hexagonal pack configuration shown in FIG. 4, only primary shields 10 are necessary to be positioned between adjacent warheads.

Both shields 10 and 12 are made of a tungsten powder having particle sizes which range from 0.5μ to 7.0μ and a binder of epoxy such as EPON 828 manufactured by The Shell Chemical Company in such proportions as to yield an overall density of 5 grams/cm$^3$ in the range 4.8 to 5.2 grams/cm$^3$. This composite not only has high density but also a high shock transit time (acoustical thickness). In other words, the shock wave from an exploding round takes much longer to pass through this composite material than through a solid metal material.

Figure 5:
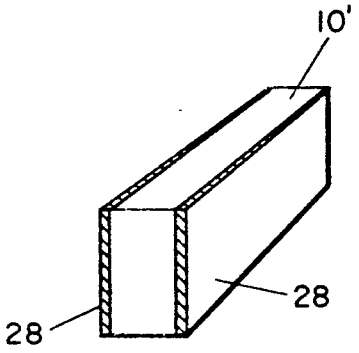
FIG. 5 is an isometric partial cross-sectional view of an alternate embodiment of the main shield of FIG. 1.
Figure 6:
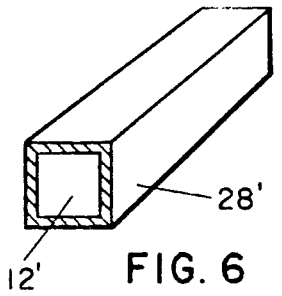
FIG. 6 is an isometric partial cross-sectional view of an alternate embodiment of the secondary shield of FIG. 2.

Referring now to FIGS. 5 and 6, an additional embodiment of the primary and secondary shields may include outer layers of methyl methacrylate (Plexiglas), or other plastic materials thereon. The outer layers preferably will have an acoustical thickness (measured in large shock transit time) equal to the acoustical thickness of the explosive round's wall. The plastic material should be selected should have a density of approximately 1 gram/cm$^3$ in the range of 0.8 to 1.2 grams/cm$^3$. In the preferred embodiment for the primary shield shown in FIG. 5, two outer layers of plastic 4.76 mm thick were added to the aforementioned tungsten-plastic composite core 10$^1$. For the secondary shield shown in FIG. 6, a plastic outer layer 28$^1$ was added on all four sides of the inner tungsten-plastic composite core 12$^1$. For tank applications, this outer layer of plastic material 28, 28$^1$ may be provided by sleeves used as racks to hold the rounds in the tank. Other materials than plastic can be used in this shielding application, although the different densities cause a shock impedance mismatch when using plastic, provides better isolation when compared to instances where no sleeve is employed. Best results were obtained when the thickness of the shields 10$^1$ and 12$^1$ were made equal to the space between rounds. For the 120 mm HEAT round this was 3.05 cm plus 4.76 mm of sleeve material on each side of the shield 10$^1$ and 12$^1$.

Substitution of other high density materials for items 10$^1$ and 12$^1$ in the designs of FIGS. 5 and 6 can be made for the purposes of reduced cost. While the tungsten-plastic composite core has proved superior, experimental tests using the designs in FIGS. 5 and 6 with steel cores have proven to be an effective substitute in cases where less sensitive explosive filled warheads have been employed. Effectiveness of this design depends strongly on the impedance mismatch between the high density core materials (10$^1$ and 12$^1$ of FIGS. 5 and 6) and the low density outer layers.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

What is claimed is:

1. Apparatus for reduction of munition fratricide hazard which comprises:

a plurality of explosive rounds operatively stacked in a symmetrical geometrical pattern; and shield means for preventing detonation propagation between said rounds, operatively disposed intermediate each adjacent round of said plurality of rounds, which includes at least one composite shield member made of a tungsten powder having particle diameters in the range of 0.5 microns to 7.0 microns and a plastic binder in such proportions as to yield an overall density of 5±0.2 grams per cubic centimeter.

2. Apparatus as recited in claim 1 wherein said plurality of explosive rounds are operatively positioned in a rectangular packing configuration.

3. Apparatus as recited in claim 2 wherein said shield means includes;

a primary shield member having a width equal to one half the diameter of said round, and a secondary shield member operatively positioned between each diagonally spaced round which includes;

a squarely shaped member made of said tungsten-plastic composite material.

4. Apparatus as recited in claim 3 wherein said primary and secondary shield members include members having lengths which at least extend beyond a portion of said round.

5. Apparatus as recited in claim 4 wherein said secondary shield members include square shaped members having corners which intercept an imaginary line drawn from the center of a round to the nearest diagonally neighboring round.

6. Apparatus as recited in claim 1 wherein said plurality of explosive rounds are operatively disposed in a hexagonal packing configuration.

7. Apparatus as recited in claim 1 which further comprises a outer layer of plastic material disposed on said composite shield member, said outer plastic layer having a density of 1±0.2 grams per cubic centimeter and an acoustical thickness equal to the acoustical thickness of a wall of said munition round.

8. Apparatus as recited in claim 7 wherein said plastic material is methyl methacrylate.

* * * * *